US007040622B2

(12) United States Patent
Sebesta et al.

(10) Patent No.: US 7,040,622 B2
(45) Date of Patent: May 9, 2006

(54) BOARD GAME WITH WEDDING ANNIVERSARY THEME AND METHOD FOR PLAYING THE SAME

(75) Inventors: Erik Sebesta, Cambridge, MA (US); Helen Marie Sebesta, East Greenwich, RI (US)

(73) Assignee: Sebesta Enterprises, Inc., Cambridge, MA (US)

( * ) Notice: Subject to any disclaimer, the term of this patent is extended or adjusted under 35 U.S.C. 154(b) by 0 days.

(21) Appl. No.: 10/439,050

(22) Filed: May 15, 2003

(65) Prior Publication Data

US 2004/0227288 A1 Nov. 18, 2004

(51) Int. Cl.
*A63F 3/00* (2006.01)

(52) U.S. Cl. ..... 273/236; 273/273

(58) Field of Classification Search ..... 273/236, 273/273, 429, 430, 431, 432
See application file for complete search history.

(56) References Cited

U.S. PATENT DOCUMENTS 2,959,871 A * 11/1960 Honkavaara ..... 434/236
3,841,628 A * 10/1974 Goldfarb ..... 273/445
4,498,869 A * 2/1985 Faison ..... 434/184
4,944,519 A * 7/1990 Canela ..... 273/243
5,288,075 A * 2/1994 Kelley ..... 273/243
5,626,477 A * 5/1997 Adkison ..... 434/128
6,139,016 A * 10/2000 Plato ..... 273/242

OTHER PUBLICATIONS

Ex.Parte Breslow 192 USPQ 431.*
Ex. Parte Breslow 192 USPQ 431.*
Board game Express (group photo games) 1 page.*
You haven't changed a bit board game 1 page.*
http://www.youhaventchangedabit.com/.
http://www.youhaventchangedabit.com/order-game.htm.
http://www.youhaventchangedabit.com/about-the-game.htm.
http://www.youhaventchangedabit.com/about-us.htm.
http://www.youhaventchangeabit.com/customer.review.htm.
http://www.youhaventchangedabit.com/open-box.htm.
http://www.youhaventchangedabit.com/contact.htm.

* cited by examiner

*Primary Examiner*—Vishu K. mendiratta
(74) *Attorney, Agent, or Firm*—Guerin & Rodriguez, LLP; William G. Guerin

(57) ABSTRACT

A game apparatus and a method of playing a game are described. According to the method, a plurality of images on a game board is viewed. Each image has a board identifier and shows a subject at a first date. A plurality of cards is viewed. Each of the cards has a card image and a card identifier, and shows one of the subjects at a second date. The method includes matching the cards with the images in response to perceived similarities. Multiple players or teams can perform the method and a winner is determined according to the player or team achieving the greatest number of correct answers.

22 Claims, 4 Drawing Sheets

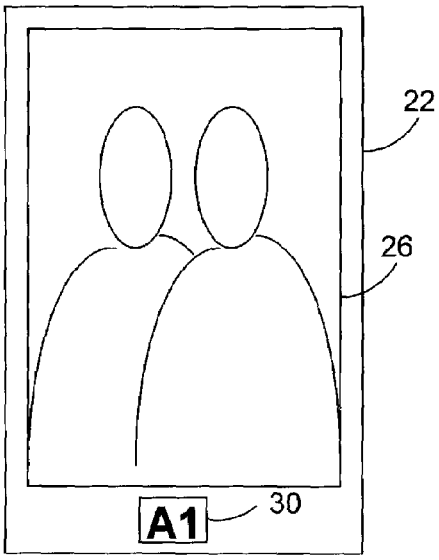
FIG. 2A
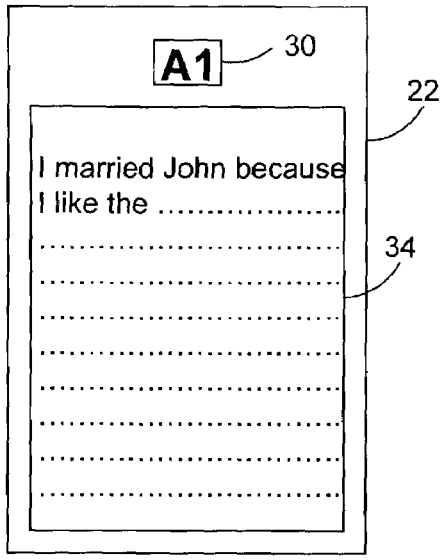
FIG. 2B
38
| A, AA PLAYER ANSWER CARD | | |
|---|---|---|
| NEWLYWED COUPLE | MATCHING ANNIVERSARY CARD | CORRECT ANSWER |
| ADAMS | A8 | ✓ |
| BUSH | A2 | |
| CARTER | A4 | |
| CLINTON | A3 | ✓ |
| FORD | A12 | |
| JOHNSON | A1 | ✓ |
| JONES | A7 | ✓ |
| LINCOLN | A5 | |
| PETERSON | A6 | |
| SMITH | A9 | ✓ |
| WASHINGTON | A11 | |
| WHITNEY | A10 | |
| TOTAL | | 5 |
FIG. 3

42

| ANSWER SET FOR A, AA | | |
|---|---|---|
| NEWLYWED COUPLE | MATCHING ANNIVERSARY CARD | CLUES |
| ADAMS | A8 | SMILES ARE SIMILAR |
| BUSH | A10 | BODY POSITION IS SAME |
| CARTER | A11 | NOSES ARE UNCHANGED |
| CLINTON | A3 | STILL NATTILY DRESSED |
| FORD | A6 | STILL HOLDING HANDS |
| JOHNSON | A1 | ... |
| JONES | A7 | ... |
| LINCOLN | A5 | ... |
| PETERSON | A12 | ... |
| SMITH | A9 | ... |
| WASHINGTON | A4 | SHEER LUCK |
| WHITNEY | A2 | PROCESS OF ELIMINATION |

FIG. 4

BOARD GAME WITH WEDDING ANNIVERSARY THEME AND METHOD FOR PLAYING THE SAME

FIELD OF THE INVENTION

The invention relates to board games and more particularly to a themed board game for matching each of a set of photographs of newly married couples with a respective photograph of each of the married couples taken at a later date such as a marriage anniversary date.

BACKGROUND

Board games are intended as a source of entertainment for players. Many board games are designed around themes that make them particularly enjoyable to specific groups in which each member shares a common theme. For example, people meet at bridal showers, bachelor and bachelorette parties to celebrate in advance of a wedding date. Similarly, people gather at parties to celebrate the wedding anniversaries of family members and friends. Preferably, the entertainment at such parties concentrates on the anticipated or pending marriage. Moreover, it would be amusing, if not educational, if the entertainment could depict how married couples evolve after years of marriage.

Accordingly, a new game that can engage the participants at a wedding-related activity such as a pre-wedding party or a bridal shower is desirable. The present invention provides a fun and challenging game for this purpose.

SUMMARY OF THE INVENTION

In one aspect, the invention features a method of playing a game. The method includes viewing a plurality of images on a game board and viewing a plurality of cards. Each image on the game board has a board identifier and shows at least one subject on a first date. Each card has a card image and a card identifier, and shows one of the at least one subjects at a second date. The method also includes matching one of the cards and one of the images on the game board in response to a similarity perceived between the matched card and the matched image. In one embodiment, each image on the game board includes a photograph. In another embodiment, each card includes a photograph. In yet another embodiment, the at least one subject is a married couple.

In another aspect, the invention features a game apparatus including a game surface, a plurality of cards, and a plurality of player answer cards. The game surface includes a plurality of images with each image having a board identifier and showing at least one subject at a first date. Each of the cards has a card image and a card identifier. At least a portion of the plurality of cards have images showing one of the plurality of the at least one subject at a second date. The player answer cards provide for recording the matching of each of the images on the game surface with a respective one of the cards. In one embodiment, the game apparatus also includes a correct answer card showing the board identifiers with their respective card identifiers to indicate correct matches. In another embodiment, each of the images on the game surface includes a photograph. In yet another embodiment, each of the card images includes a photograph.

In another aspect, the invention features a game apparatus including a board having a plurality of photographs, a plurality of cards, a player answer card and a correct answer card. Each photograph on the game board has a board identifier and shows a married couple on a marriage date. Each card has a card photograph and a card identifier. Each card photograph shows a respective married couple shown on the board at a date subsequent to the respective marriage date. The player answer card lists the board identifiers and includes a region for recording a card identifier for each of the board identifiers. The correct answer card lists the board identifiers and the respective card identifiers for indicating correct matches. In one embodiment, the game apparatus also includes a second plurality of cards each having a card photograph and a card identifier. Each of the cards in the second plurality of cards shows a married couple that is not shown on the board.

BRIEF DESCRIPTION OF THE DRAWINGS

The above and further advantages of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

FIGS. 2A and 2B depict the front and back, respectively, of a card used in playing a game according to an embodiment of the present invention.

FIG. 3 is an illustration of a player answer card according to an embodiment of the present invention.

FIG. 4 is an illustration of a correct answer card used to determine a score from the player answer card of FIG. 3.

DETAILED DESCRIPTION

In brief overview, a game constructed in accordance with the present invention enables a player (or a team of players) to view a first collection of images each taken at a first time and a second collection of images each taken at a later time. At least a portion of the second collection of images includes subjects that are represented in the first collection of images. Players attempt to match each image in the first collection with a respective image in the second collection. A score is determined according to the number of correct matches by each player as determined from a correct answer card. The winner is the player (or team of players) that correctly matches the most images.

In a preferred embodiment, each image in the first collection is a photograph of two people married to each other, i.e., a married couple, taken on or about their marriage date. For example, the photograph can be taken at a wedding ceremony. Each image in the second collection is a photograph of one of the married couples of the first collection taken on or about a common anniversary date such as a $50^{th}$ anniversary. In an alternative embodiment, the number of photographs in the second collection exceeds the number of photographs in the first collection. That is, there are photographs in the second collection that have no matching photograph in the first collection. Consequently, the ability for a player to correctly match photographs decreases as the number of photographs in the second collection increases.

Players attempt to match the photographs based on common physical characteristics. For example, physical features of correctly matched couples may be similar. Physical features can include facial features and expressions, posture and manner of dress. The players gain an appreciation of how significant changes can occur through aging and other factors after many years of marriage. In one embodiment, one of the collections of photographs includes anecdotal information describing, for example, how the married couple first met, how the marriage proposal occurred, the reason for accepting the marriage proposal or characteristics about the married couple which have not changed.

Figure 1A:
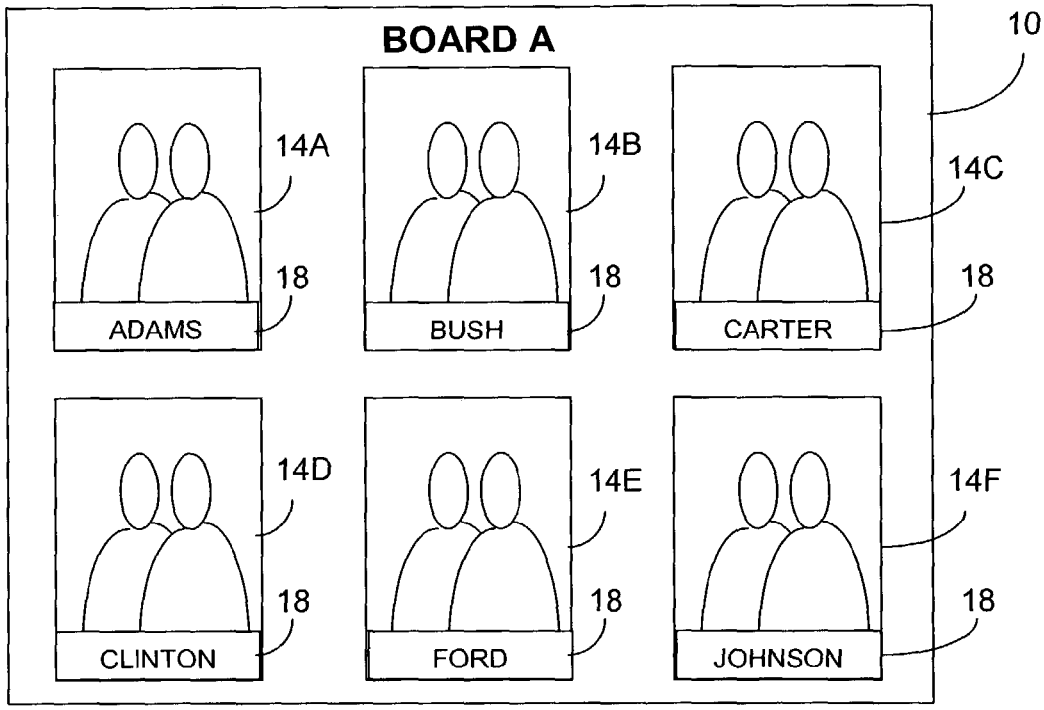
FIGS. 1A and 1B are illustrations of game boards according to an embodiment of the present invention.
Figure 1B:
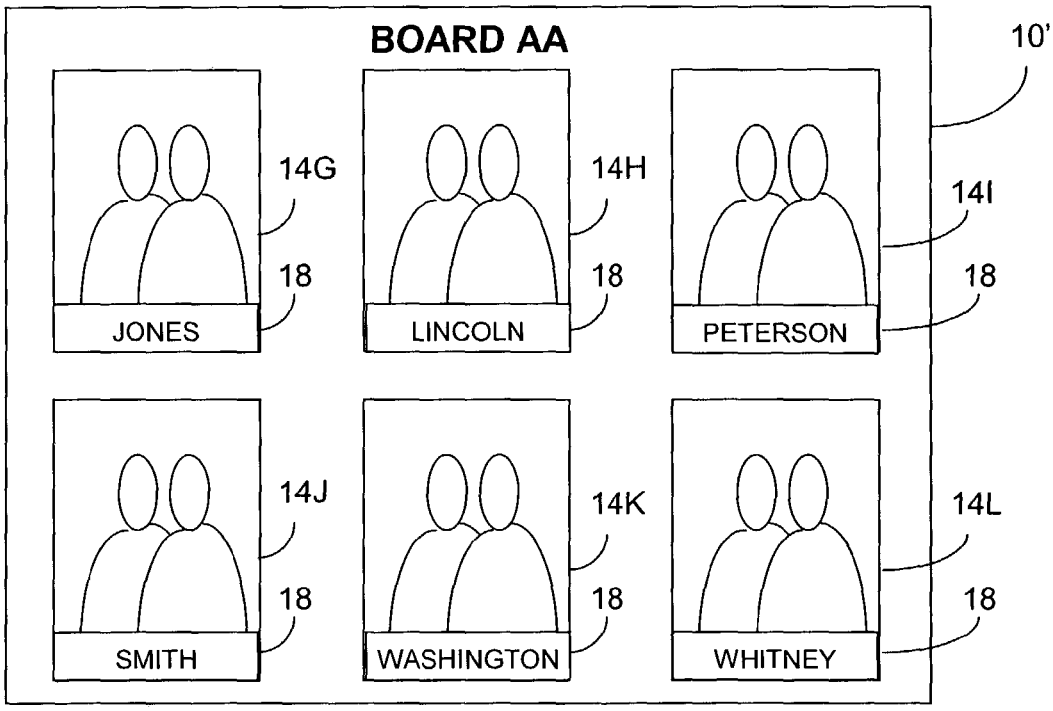

Referring to FIG. 1A, the game according to an embodiment of the present invention includes a game board A 10 having a set of photographs 14A to 14F of married couples taken on or about their marriage date and a second game board AA 10' having a set of photographs 14G to 14L of married couples as shown in FIG. 11B. Each photograph 14 is labeled with a board identifier 18. For example, the board identifier 18 can be the last name (or last names) of the married couples depicted in the photographs 14.

In one embodiment the game boards A 10 and AA 10' are integrated as a single unit having two panels in which one panel shows photographs 14A to 14F and the second panel shows photographs 14G to 14L. The unit may fold about an axis separating the two panels for convenience. In another embodiment the game boards A 10 and AA 10' are integrated as a single board on which one side shows photographs 14A to 14F and the opposite side shows photographs 14G to 14L. It should be recognized that game boards A 10 and AA 10' can be provided in many other forms. For example, the game boards A 10 and AA 10' may not be a single board showing photographs 14 but can be a deck of cards that can be laid out on a surface (e.g., a table top) for viewing by the players.

FIGS. 2A and 2B depict the front and back, respectively, of a card 22 used in playing the game. The total number of cards 22 used in the game is equal to the number of photographs 14 shown on the game boards A 10, AA 10'. In an alternative embodiment, the total number of cards exceeds the number of photographs 14 on the game boards A 10, AA 10' to increase the difficulty of matching cards 22 with their respective photographs 14. According to the alternative option, some of the cards 22 include card photographs 26 that depict couples not shown on the game boards A 10, AA 10'.

Each card 22 includes a card photograph 26 and a unique card identifier 30 on its front surface. Each card photograph 26 depicts one of the married couples shown on the game boards A 10, AA 10' after an extended period of marriage (e.g., 50 years). Each card 22 also includes anecdotal text 34 and the card identifier 30 on its back surface. By way of example, anecdotal text 34 relates one or more brief stories relating to the depicted married couple, such as where the couple went for their honeymoon, details of the marriage proposal, and why one of the couple agreed to accept the marriage proposal.

If the game is provided with multiple playing boards, for example, four boards labeled A, AA, B and BB, it is desirable to limit the number of cards 22 to be matched by assigning each card 22 to a subset of playing boards (e.g., A and AA) to limit the level of difficulty in playing the game. For example, if each of the four boards A, AA, B, BB has six photographs 14 and the game includes 24 cards 22, the cards 22 are separated into two sets A and B such that cards 22 having card identifiers 30 for set A (e.g., A1 to A12) are known to match the photographs 14 on boards A and AA, and cards having card identifiers 30 for set B (e.g., B1 to B12) are known to match the photographs 14 on boards B and BB. Each board A, AA, B and BB and the card identifiers 30 of its respective cards 22 are color-coded to indicate the correct association.

FIG. 3 depicts a player answer card 38 used to record the answers of a player or a team of players. The player answer card 38 includes a first column listing the board identifiers 18, a second column for a player to enter (i.e., write) the card identifiers 30 to match a card 22 to each listed board identifier 18, and a third column for indicating which entries in the second column are correct. A correct match is determined using a correct answer card described below. The position at the bottom of the third column is reserved for indicating the number of correct answers as indicated in the third column.

FIG. 4 shows a correct answer card 42 used to determine which matches recorded on a player answer card 38 are correct. The correct answer card 42 includes a first column listing the board identifiers 18, a second column indicating the correct card identifiers 30 for each board identifier 18, and a third column labeled CLUES that provides an indication as to why each card 22 is matched with its corresponding photograph 14. The correct answer cards 42 are provided in a Mylar wrapper for durability. Optionally, the cards are enclosed in an opaque envelope or sleeve to prevent inadvertent viewing prior to completion of a game or a game round. The correct answer cards 42 are similarly sized and formatted to the player answer cards 38. Consequently, the correct answer cards can be placed adjacent to the player answer cards 38 to facilitate determination of which player entries in the second column of the player answer cards 38 are correct.

Figure 5:
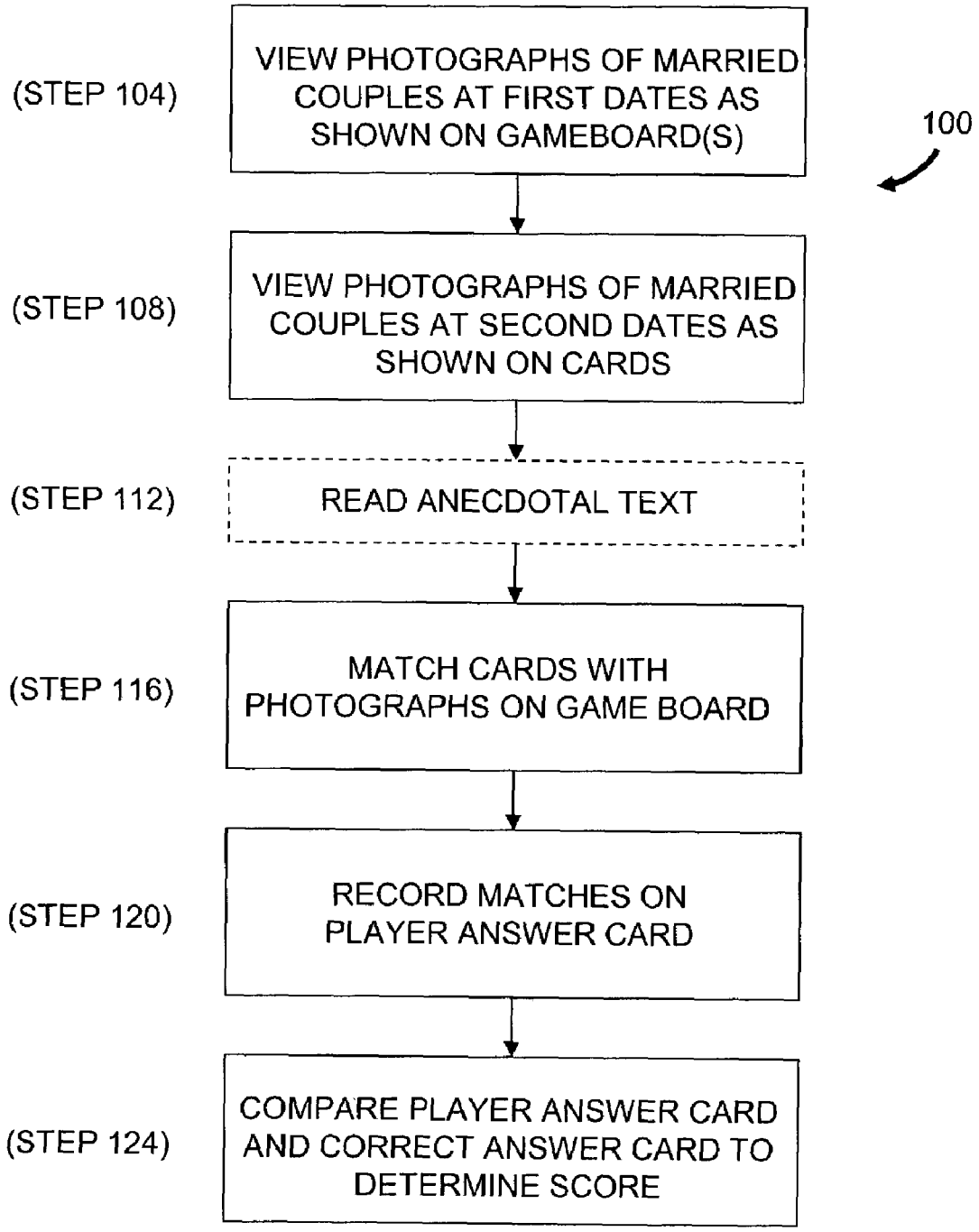
FIG. 5 is a flowchart representation of an embodiment of a method of playing a game according to the present invention.

Many variations of game play are possible. The game can be played without any time limit for completing the player answer card 38. Alternatively, a time limit can be enforced to motivate players or teams to complete their player answer cards 38 in a timely manner. Referring to FIG. 5, a method 100 for playing a single team (or single player) game is shown as a series of steps. The team receives one game board set A 10, AA 10', a corresponding set of cards 22, and a player answer card 38. The photographs 14 on the game board set A 10, AA 10' and the card photographs 26 are viewed (steps 104 and 108, respectively). Optionally, the anecdotal text on one or more cards 22 is read (step 112). Cards 22 are then matched (step 116) with photographs 14 on the game board set A 10, AA 10' generally by placing a card 22 adjacent to the photograph 14 which the player (or team) believes represents the same married couple. The matches are recorded (step 120) on the player answer card 38. The correct answer card 42 is compared (step 124) to the player answer card 38 to determine which matches are correct and to calculate the score (i.e., the number of correct matches indicated on the card).

According to a two team short variation of the game, each team (or player) receives one game board set A and AA or B and BB and the corresponding card set. Each team matches a card 22 with each photograph 14 on its boards A, AA or B, BB. Once both teams have completed their player answer cards 38, the correct answer cards 42 are examined to determine the number of correct answers for each team. The team with the greatest number of correct answers is declared the winner. If each team achieves the same number of correct answers, the winner is the first team that completed its player answer card 38.

A two team extended variation of the game is played by completing a first round in which each team matches a card 22 with each photograph 14 on its boards and completes a player answer card 38. The teams then exchange the game board sets (A and AA, B and BB) and card sets. A second round is then played. Each team compares its cards 22 with the correct answer cards 42 to determine the number of correct answers for both rounds. The team with the greatest number of correct answers is declared the winner. Again, if each team has the same number of correct answers, the winner is determined according to which team completed its player answer cards 38 in the shortest time.

A four team variation is played by providing each team with a single game board (A or AA or B or BB) and having a neutral person (i.e., non-player) separate each card group into two smaller card sets corresponding to the proper game board A, AA, B, BB as determined by the correct answer cards 42.

The games can be provided in different versions. For example, a game played in one geographic region can include photographs 14 depicting married couples from that region. The game can also be adapted to the particular players. For example, the photographs 14 on the game board 10 can include photographs of friends and/or family members of the players.

In some embodiments the game is embodied in software executable on a computer or software accessible via a computer network such as the Internet. The game board and cards according to these embodiments are displayed as unique objects on a computer monitor. In further embodiments players enter answers using a computer keyboard, and correct answers and scores are determined by the software.

In another embodiment the game is provided as part of a calendar. A number of photographs 26 (e.g., four photographs) of married couples on a common anniversary are shown on a page representing the days in one month along with a single photograph 14 of one of the married couples on their wedding day. The correct answer can be displayed on the page for the subsequent month in the calendar. Alternatively, the correct answers for each monthly game can be provided on the last page of the calendar or the back of the calendar.

While the invention has been shown and described with reference to specific preferred embodiments, it should be understood by those skilled in the art that various changes in form and detail may be made therein without departing from the spirit and scope of the invention as defined by the following claims. For example, the game can include a sheet or other object having a surface to display photographs. In other examples, the subject of each photograph is an individual, an object or a group of objects, and the goal of the game is to recognize common subjects as they have evolved through time.

What is claimed is:

1. A method of playing a game, the method comprising:

viewing a plurality of board images on a game board, each of the board images having a board identifier and showing a subject;

viewing a plurality of cards, each of the cards having a card identifier and a card image showing the subject depicted in a respective one of the board images, each card image and the respective board image when compared showing a visible difference in the subject depicted therein caused by aging; and matching one of the cards and one of the board images in response to a perceived similarity therebetween.

2. The method of claim 1 wherein each of the board images comprises a photograph.

3. The method of claim 1 wherein each of the card images comprises a photograph.

4. The method of claim 1 wherein at least one of the game board and the plurality of cards is displayed on a monitor.

5. The method of claim 1 wherein each of the cards has complementary information shown thereon and wherein the step of matching comprises determining a correlation between the complementary information on the one of the cards and the one of the board images.

6. The method of claim 5 wherein the complementary information comprises anecdotal text describing the at least one subject.

7. The method of claim 1 wherein the subject comprises a married couple.

8. The method of claim 7 wherein one of the board images and the card images was generated near a date of marriage for the married couple.

9. The method of claim 7 wherein one of the board images and the card images was generated near a marriage anniversary date for the married couple.

10. The method of claim 1 further comprising recording the matching of the one of the cards and one of the board images on a player answer sheet.

11. The method of claim 1 wherein the step of matching comprises matching each of the board images with a respective one of the cards.

12. The method of claim 11 further comprising indicating the matching of each of the board images with a respective one of the cards by recording a card identifier with a board identifier on a player answer card.

13. The method of claim 12 further comprising determining a score by comparing the recorded player answer card and a correct answer card.

14. A game apparatus, comprising:

a game surface having a plurality of board images thereon, each of the board images having a board identifier and showing a subject;

a plurality of cards, each of the cards having a card image and a card identifier, at least one of the cards having a card image showing one of the subjects depicted in a respective one of the board images that when compared show a visible difference in the subject depicted therein caused by aging; and a plurality of player answer cards for recording the matching of each of the board images with a respective one of the cards.

15. The game apparatus of claim 14 further comprising a correct answer card showing the board identifiers with their respective card identifiers to indicate correct matches.

16. The game apparatus of claim 15 wherein at least one of the game surface, the plurality of cards, the plurality of player answer cards and the correct answer card are displayed on a monitor.

17. The game apparatus of claim 14 wherein each of the board images comprises a photograph.

18. The game apparatus of claim 14 wherein each of card images comprises a photograph.

19. The game apparatus of claim 14 further comprising a second surface having a plurality of board images, each of the board images on the second surface having a board identifier and showing a subject.

20. The game apparatus of claim 19 wherein the first surface and the second surface are integrated as a single game board.

21. A game apparatus, comprising:

a board having a plurality of photographs, each of the photographs having a board identifier and showing a married couple on a marriage date;

a plurality of cards, each of the cards having a card photograph and a card identifier, each that when compared shows a visible difference in the married couple card photograph showing a respective married couple shown on the board shown therein caused by aging; the respective marriage date;

a player answer card having the board identifiers listed thereon and a region for recording a card identifier for each of the board identifiers; and a correct answer card having the board identifiers and the respective card identifiers for indicating correct matches listed thereon.

22. The game apparatus of claim 21 further comprising a second plurality of cards each having a card photograph and a card identifier, each of the cards in the second plurality of cards showing a married couple that is not shown on the board.

* * * * *